US008628298B1

(12) United States Patent
Liang

(10) Patent No.: US 8,628,298 B1
(45) Date of Patent: Jan. 14, 2014

(54) TURBINE ROTOR BLADE WITH SERPENTINE COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 443 days.

(21) Appl. No.: 13/189,075

(22) Filed: Jul. 22, 2011

(51) Int. Cl.
*F01D 5/08* (2006.01)

(52) U.S. Cl.
USPC ..... 416/96 R; 416/97 R

(58) Field of Classification Search
USPC ..... 416/97 R, 90 R, 96 R; 415/115
See application file for complete search history.

(56) References Cited

U.S. PATENT DOCUMENTS

| | | | | | |
|---|---|---|---|---|---|
| 3,533,711 | A * | 10/1970 | Kercher | 416/90 R |
| 3,656,863 | A * | 4/1972 | De Feo | 416/97 R |
| 4,136,516 | A * | 1/1979 | Corsmeier | 60/39.091 |
| 4,462,754 | A * | 7/1984 | Schofield | 416/97 R |
| 4,992,026 | A * | 2/1991 | Ohtomo et al. | 416/97 R |
| 5,902,093 | A * | 5/1999 | Liotta et al. | 416/97 R |
| 5,915,923 | A * | 6/1999 | Tomita et al. | 416/96 R |
| 5,975,851 | A * | 11/1999 | Liang | 416/97 R |
| 6,139,269 | A * | 10/2000 | Liang | 416/97 R |
| 6,220,817 | B1 * | 4/2001 | Durgin et al. | 416/97 R |
| 6,290,463 | B1 * | 9/2001 | Fargher et al. | 416/97 R |
| 6,481,967 | B2 * | 11/2002 | Tomita et al. | 416/97 R |
| 6,491,496 | B2 * | 12/2002 | Starkweather | 416/97 R |
| 6,988,872 | B2 * | 1/2006 | Soechting et al. | 416/96 R |
| 7,413,406 | B2 * | 8/2008 | Pietraszkiewicz et al. | 416/96 R |
| 7,695,245 | B1 * | 4/2010 | Liang | 416/1 |
| 7,806,659 | B1 * | 10/2010 | Liang | 416/97 R |
| 7,950,903 | B1 * | 5/2011 | Liang | 416/97 R |
| 7,988,417 | B1 * | 8/2011 | Liang | 416/90 R |
| 7,988,419 | B1 * | 8/2011 | Liang | 416/97 R |
| 8,118,553 | B2 * | 2/2012 | Liang | 416/96 R |
| 8,133,024 | B1 * | 3/2012 | Liang | 416/1 |
| 8,317,472 | B1 * | 11/2012 | Liang | 416/92 |
| 8,398,371 | B1 * | 3/2013 | Liang | 416/97 R |
| 8,491,264 | B1 * | 7/2013 | Liang | 416/97 R |
| 2002/0119045 | A1 * | 8/2002 | Starkweather | 416/97 R |
| 2005/0129516 | A1 * | 6/2005 | Rinck et al. | 416/97 R |
| 2005/0281674 | A1 * | 12/2005 | Liang | 416/97 R |
| 2007/0081894 | A1 * | 4/2007 | Garner | 416/97 R |
| 2007/0189897 | A1 * | 8/2007 | Pietraszkiewicz et al. | 416/97 R |
| 2010/0226788 | A1 * | 9/2010 | Liang | 416/97 R |
| 2011/0033312 | A1 * | 2/2011 | Lee et al. | 416/97 R |
| 2013/0045111 | A1 * | 2/2013 | Lee | 416/97 R |
| 2013/0084191 | A1 * | 4/2013 | Jiang | 416/97 R |
| 2013/0115101 | A1 * | 5/2013 | Walunj et al. | 416/97 R |

* cited by examiner

*Primary Examiner* — Nathaniel Wiehe
*Assistant Examiner* — Eldon Brockman
(74) *Attorney, Agent, or Firm* — John Ryznic

(57) ABSTRACT

A turbine rotor blade has a number of serpentine flow cooling circuits to provide cooling to forward and aft sections of the airfoil and to upper span and lower span sections of the airfoil in order to provide specific cooling to directed sections of the airfoil. A common cooling air supply channel extends the entire spanwise length of the airfoil and supplies cooling air to each of the serpentine flow cooling circuits.

6 Claims, 6 Drawing Sheets

TURBINE ROTOR BLADE WITH SERPENTINE COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to a turbine rotor blade with cooling.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

In a turbine, the rotor blades are exposed to different stress loads than the stator vanes. Because the rotor blades rotate (stator vanes do not rotate), the blades are under high stress loads due the centrifugal force of rotation. A rotor blade is thick in the lower span and tapers off in the direction toward the tip with the thinnest section being located at the tip. The upper span of the blade will thus have the lowest mass to carry while the lower span near to the platform will have the highest mass to carry. All of the blade above the platform must be carried by the lower span of the blade. The highest stress loads are then found at the lower span sections. In addition, where the blade is exposed to the very high temperatures, the metal material strength decreases. Thus, the blade shape and cooling circuitry must be designed to account for both the stress loads and the thermal stress due to normal operation in the engine. This is especially important for industrial engine blades because the life cycle must be very long.

FIG. 1 shows the external pressure profile for a prior art first stage blade. As shown in FIG. 1, the forward region of the pressure side surface experiences a high hot gas static pressure while the entire suction side of the airfoil is at a much lower hot gas static pressure than on the pressure side. The area within the two curves to the left of the mid-chord section is at a lower work pressure 11 while the area 12 is at a high delta working pressure. This translates into more cooling air working potential toward the trailing edge than in the leading edge.

FIG. 2 shows a blade external heat transfer coefficient for a turbine rotor blade. As shown in FIG. 2, the airfoil leading edge, the suction side immediately downstream of the leading edge, as well as the pressure side trailing edge region of the airfoil experience the higher hot gas side external heat transfer coefficient than the mid-chord section of the pressure side and downstream of the suction surfaces. Point 13 is the high heat load region for the blade leading edge, point 14 is the high heat load aft section of the P/S surface, point 15 is the low Q on the pressure side (P/S) and point 16 is a high Q on the suction side (S/S). In general, the heat load for the airfoil aft section is higher than in the forward section.

FIG. 3 shows the blade mainstream gas temperature profile. As seen in FIG. 3, the maximum gas temperature occurs at around 75% of the blade span height located at point 17. This translates into a high heat load. Since the pull stress at the blade upper span is low, it allows for the blade to run at a higher metal temperature. Below the 40% blade span height, the gas temperature drops off to a lower level that results in a lower heat load on the blade. This drop-off of the gas side temperature is good for the blade creep design, especially for the lower blade region with a high blade pulling load. Point 19 is in the upper blade span in which a lower pull stress and a higher allowable metal temperature is allowed. Point 18 is at a low gas temperature which is good for stress rupture.

BRIEF SUMMARY OF THE INVENTION

The turbine rotor blade with multiple serpentine flow cooling circuits located in both the upper span and the lower span of the blade and where each span includes a forward serpentine circuit and an aft serpentine circuit so that cooling for all regions of the blade can be controlled based upon external gas flow pressure and temperature. The blade can have four or six serpentine flow cooling circuits all fed with cooling air from a common first pass channel that flows along the entire spanwise length of the blade. Cooling air from the serpentine circuits is discharged through leading edge film holes, trailing edge exit holes or blade tip discharge holes to provide cooling to these regions of the blade.

DETAILED DESCRIPTION OF THE INVENTION

Figure 1:
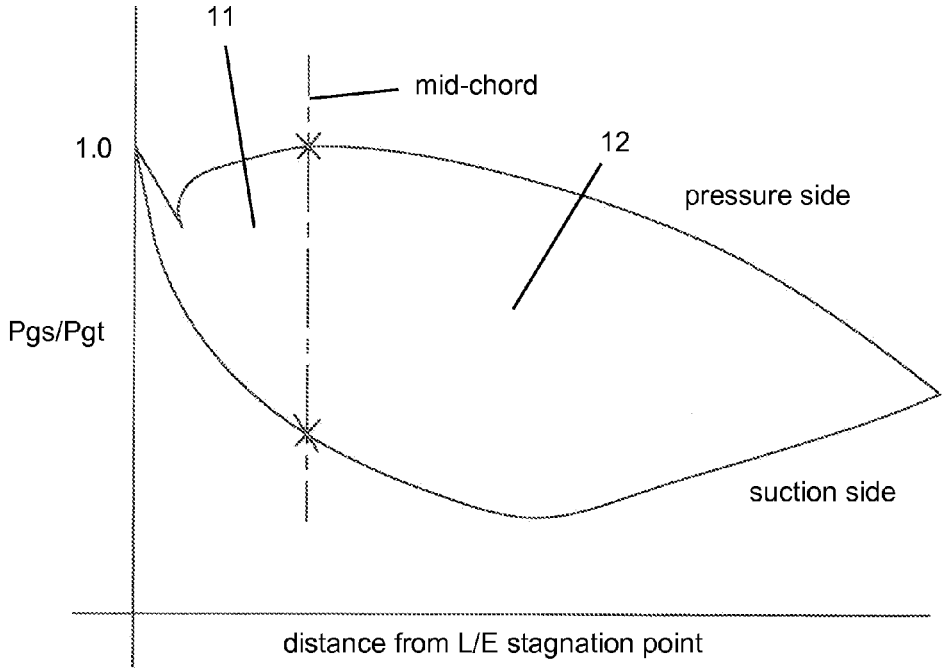
FIG. 1 shows a graph of an external pressure profile on a first stage turbine rotor blade.
Figure 2:
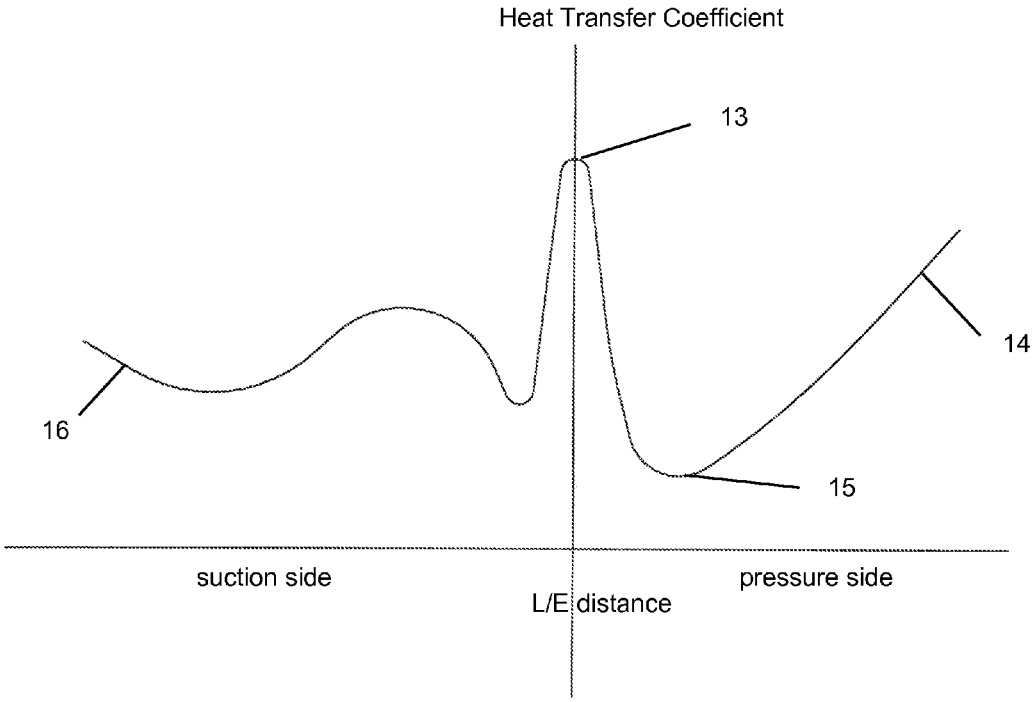
FIG. 2 shows a graph of an external heat transfer coefficient profile on a first stage turbine rotor blade.
Figure 3:
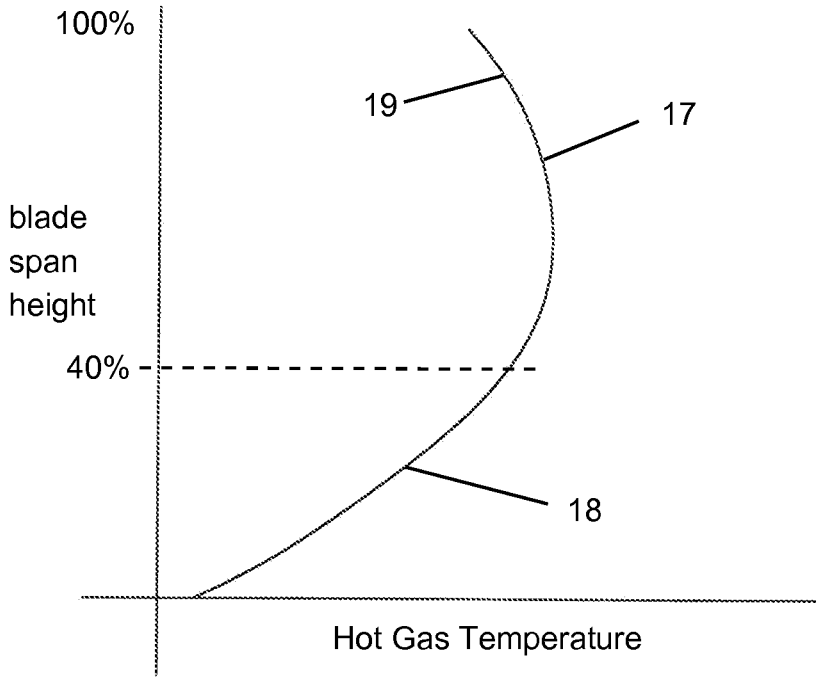
FIG. 3 shows a graph of hot gas temperature profile on a first stage turbine rotor blade.
Figure 4:
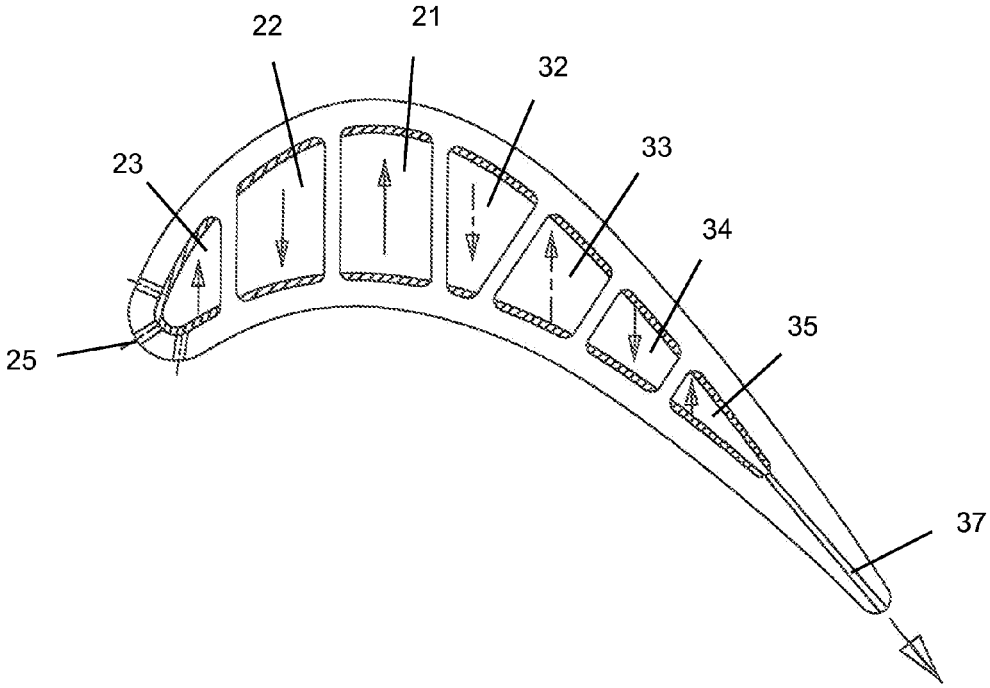
FIG. 4 shows a cross section top view of a turbine rotor blade cooling circuit of the present invention.

A turbine rotor blade, especially for a first stage rotor blade in a large frame heavy duty industrial gas turbine engine, includes multiple serpentine flow cooling circuits to provide individual cooling to sections of the airfoil based on external gas stream pressure and temperature in order to control metal temperature using a minimal amount of cooling air. In the first embodiments, three-pass and five pass serpentine circuits are used with either four serpentine circuits or six serpentine circuits used to cool the upper and lower spans and the forward and aft regions of the blade. FIG. 1 shows a cross section top view with the blade having a cooling air supply channel 21 that supplies cooling air to a serpentine circuit in the forward region through a second channel or leg 22 and a third channel or leg 23, and through an aft region through a second leg 32 followed by a third leg 33, a fourth leg 34 and a fifth leg 35 all connected in series. A showerhead arrangement of film cooling holes 25 is connected to the third leg 23 of the forward serpentine circuit while a row of exit holes 37 is connected to the fifth leg 35 to provide cooling for the leading edge and the trailing edge regions of the blade.

Figure 5:
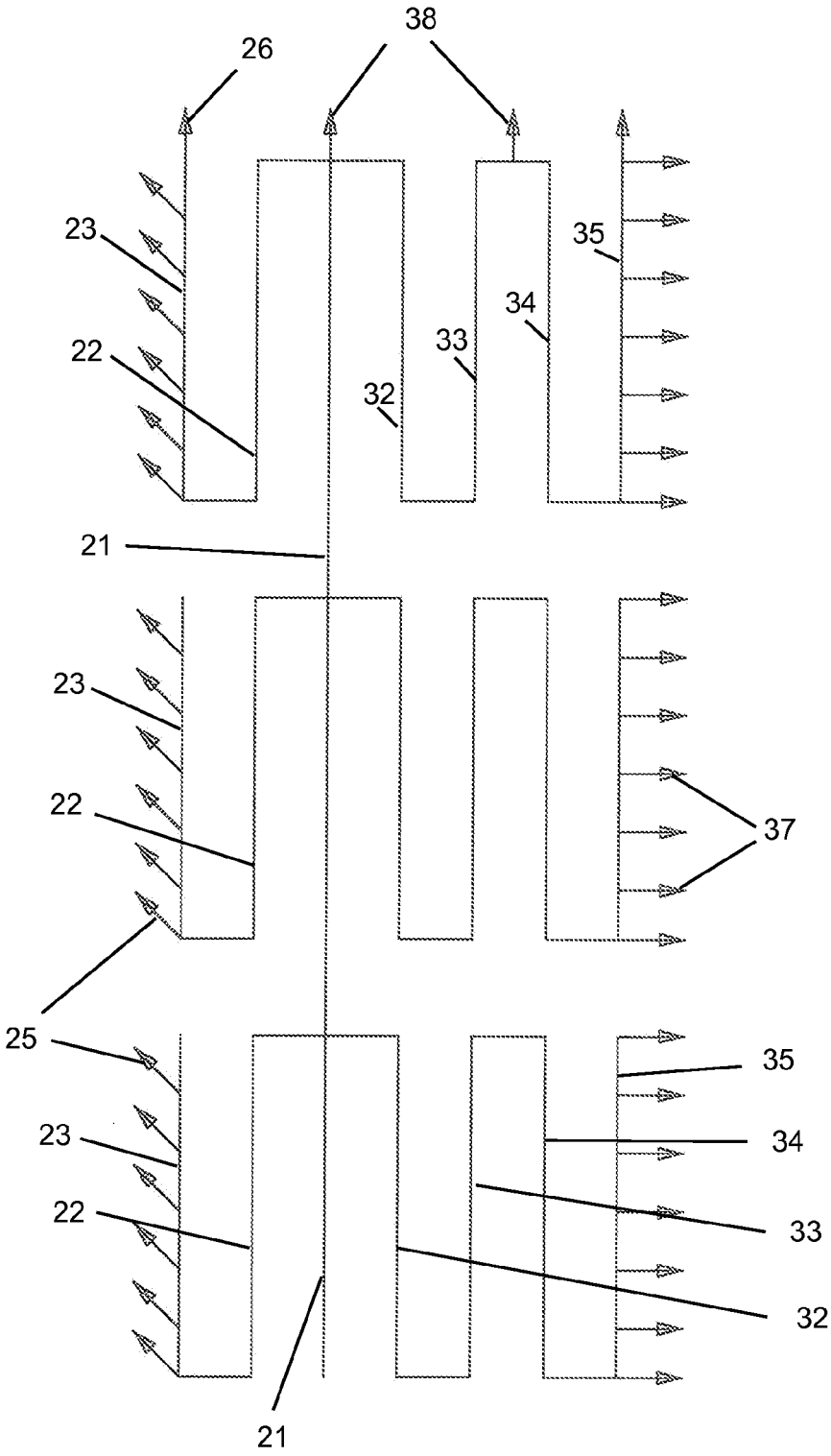
FIG. 5 shows a flow diagram for one embodiment of a multiple serpentine flow cooling circuit for a blade of the present invention.

FIG. 5 shows a flow diagram for an embodiment of the present invention that uses three serpentine circuits along the spanwise direction of the blade instead of the two serpentine circuits in the FIG. 6 embodiment described below. A common cooling air supply channel 21 supplies the cooling air for all of the serpentine circuits formed within the blade and extends the entire spanwise length of the blade ending at the blade tip. The common cooling air supply channel 21 also forms the first leg for the remaining serpentine flow circuits. As seen in FIG. 5, a second leg 22 and a third leg 23 is connected to the common first leg 21 to form a forward flowing three-pass serpentine flow cooling circuit located in the forward region of the blade and in the lower span. Located above this three-pass serpentine circuit is another similar three-pass serpentine circuit with a second leg 22 and a third leg 23 connected to the first leg 21 and in series to form a mid-span three-pass forward flowing serpentine circuit. A third three-pass serpentine flow circuit is located above the mid-span serpentine and also includes a second leg 22 and a third leg 23 to form a third forward flowing three-pass serpentine flow circuit. Each of these three-pass forward flowing serpentine flow cooling circuits are connected to film cooling holes 25 that form the showerhead arrangement of film cooling holes for the leading edge region of the blade. Tip cooling holes 26 and 38 and the ends of the first leg 21 and the third leg 26 discharge the remaining cooling air to cool the tip in this region.

The common or first leg 21 is also connected to three aft flowing five-pass serpentine flow cooling circuits to provide cooling to the aft region of the blade. Each of the three five-pass serpentine circuits includes a second leg 32, a third leg 33, a fourth leg 34 and a fifth leg 35 connected in series. A row of exit holes 37 are connected to the fifth legs 35 to discharge cooling air through the trailing edge region. The tip turn between the third 33 and fourth legs 34 and the end of the fifth leg 35 include a tip cooling hole to discharge cooling air for cooling of the tip in this section of the blade tip.

Figure 6:
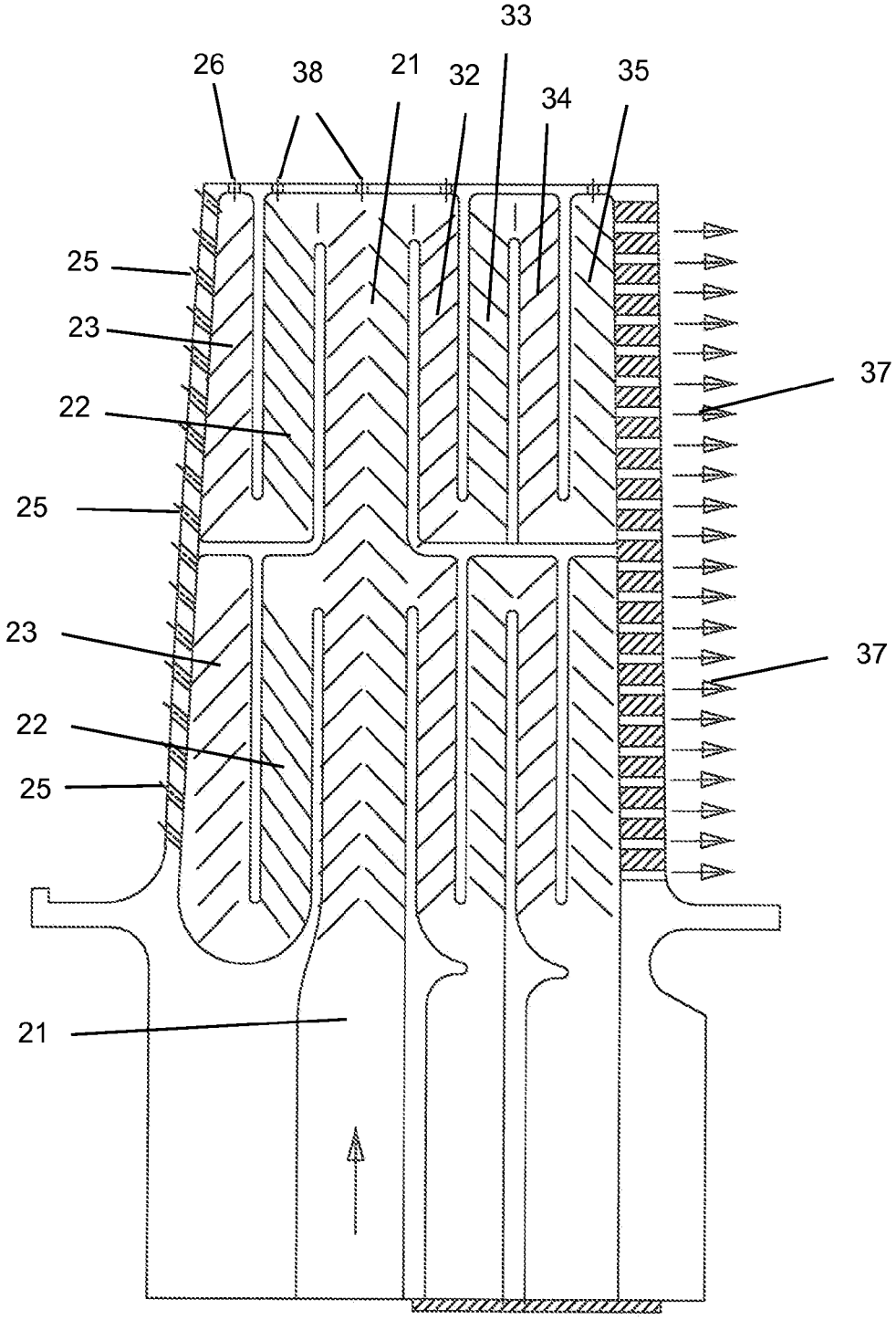
FIG. 6 shows a cross section side view of another embodiment of a multiple serpentine flow cooling circuit for a blade of the present invention.

FIG. 6 shows a cross section side view of an embodiment of the present invention in which only two serpentine circuits instead of three serpentine circuits are used in the spanwise direction. As seen in FIG. 6, in either embodiment trip strips are used on the side walls of the legs or channels to enhance the heat transfer coefficient.

In both embodiments of the present invention, cooling air supplied to the blade flows through the common channel or first leg 21 first. Some of the cooling air in the first leg 21 flows into the second leg 22 of the three-pass serpentine in the forward region and some flows into the second leg 32 in the five-pass serpentine in the aft region all in the lower span of the blade. The cooling air flows from the second leg 22 and into the third leg 23 and then discharged through the film cooling holes 25 that form the showerhead arrangement of film cooling holes. The cooling air flowing through the second leg 32 then flows into the third leg 33, the fourth leg 34 and then the fifth leg 35 and then through the row of exit holes 37 along the trailing edge of the blade. Any remaining cooling air from the first leg 21 will then flow into the next above three-pass and five-pass serpentine circuits in the respective legs and then is discharged from the film cooling holes 25 or the exit holes 37. At the end of the third leg 33 under the blade tip, the remaining cooling air flows through the tip holes 26. Tip holes 38 are also located along the legs 21, 22, 32 and 35 to discharge cooling through the blade tip.

A turbine rotor blade for an industrial engine usually includes a large cross sectional area at the blade mid-chord region and the lower span height and then tapers to a small blade thickness at the upper blade span height. The total blade cooling air is delivered through the blade mid-chord section to maximize the cooling flow mass flux and achieve a high internal through-flow velocity for the cooling air. The cooling air velocity must be above a specific velocity in order to maintain a high heat transfer coefficient. If the cooling air velocity drops below a specific speed, the cooling effectiveness decreases significantly. The cooling air is then bled off from the radial cooling air supply channel 21 and flows aft toward the trailing edge for the airfoil main body in an aft flowing five-pass serpentine flow cooling circuit. Since a high pressure differential is formed between the first leg or common channel 21 and the trailing edge exit holes 37, a five-pass aft flowing serpentine circuit can be used and will maximize the cooling pressure potential for the blade cooling. Also, as the cooling air serpentines through the channels, the airfoil tapers off toward the trailing edge and therefore reduces the cross sectional flow area of the cooling air such that the cooling side internal heat transfer coefficient increases and the reduction of the cooling potential due to heat increase is lowered. The cooling air is finally discharged through the trailing edge exit holes to provide cooling for the trailing edge corner of the blade.

Cooling air is also bled off from the main cooling air supply channel 21 for the forward flowing three-pass serpentine circuits to provide cooling to the leading edge region. Since the available pressure differential between the cooling and gas side is lower while the gas side heat transfer coefficient is high, a three-pass serpentine circuit is used in this region of the blade. The spent cooling air is then discharged through the leading edge showerhead film cooling holes to form a film cooling layer for cooling of the blade leading edge exterior region where the heat load is the highest on the entire airfoil.

Partitioning the blade into two or three sections in the spanwise direction will allow the cooling flow redistribution in the spanwise direction to be designed based on the mainstream gas temperature profile and heat load on the blade. This is different than in the prior art blades with serpentine flow cooling circuits in which the serpentine flow cooling channels extend from the platform to the blade tip. The cooling air flowing through these prior art serpentine circuits will transfer heat from the blade upper span and return the heat to the blade lower span. The cooling potential for the cooling air will therefore be reduced due to the continuous heating of the cooling air. The spanwise partition of the airfoil cooling according to the present invention will allow for a design of the blade lower half first without circulating the cooling air into the upper span and heat up the cooling air in order to yield an improved creep capability for the blade. Creep is a result of the blade stretching in radial or spanwise length from a continuous centrifugal load from operating in an engine for long periods of time. Excessive creep will also shorten a life of a blade. The present invention also allows for more distribution of cooler cooling air at the blade peak gas temperature section to achieve an improved oxidation and erosion capability. The blade heat load in the spanwise direction can therefore also be designed for to achieve desired metal temperatures throughout the blade surfaces.

Major design features and advantages of the cooling circuit of the present invention over the prior art serpentine circuit are described below. Partitioning the blade into multiple zoon increase the design flexibility for tailoring the blade cooling design for external loading conditions. The blade total cooling air is fed through the airfoil mid-chord thick section thus maximizes the use of cooling mass flux potential. Higher cooling mass flow through the airfoil main body thus yields lower mass average blade metal temperature which translates to a higher stress rupture life for the blade. Blade total cooling flow is fed through the airfoil pressure side forward section where the external gas side heat load is low. Since the cooling air temperature is fresh, as a result of this cooling air feed system it maximize the use of cooling air potential to achieve a non film cooling zone for the airfoil. The aft flowing 5-pass cooling flow mechanism maximizes the use of cooling air and provides a very high overall cooling efficiency for the after portion of the airfoil. The aft flowing serpentine cooling flow circuit used for the airfoil main body will maximize the use of cooling to main stream gas side pressure potential. Majority of the air for the 5-pass serpentine is discharged at the aft section of the airfoil where the gas side pressure is low thus yield a high cooling air to main stream pressure potential to be used for the serpentine channels and maximize the internal cooling performance for the serpentine. The aft flowing main body 5-pass serpentine flow channel yields a lower cooling supply pressure requirement and lower leakage. The short individual tier trailing edge cooling circuit provides cooler cooling air for the blade root section thus improves airfoil high cycle fatigue (HCF) capability. The current 3+5 serpentine cooling concept provides greater cooling design flexibility for the airfoil. Individual cooling flow channel can be addressed the airfoil heat load separately. The 3-pass is design for the cooling of blade leading edge forward section. The 5-pass is design for the blade trailing edge cooling. Thus maximizes the airfoil oxidation capability and allows for a higher operating temperature for future engine up-grade. Total cooling is channeled through the thickest section of the airfoil. This cooling flow management yields a good ceramic core size and thus improves casting yield.

I claim the following:

1. A turbine rotor blade for an industrial gas turbine engine, the turbine rotor blade comprising:

an airfoil section with a lower span section and an upper span section;

a common cooling air supply channel extending from a platform section to a blade tip section of the airfoil;

a first three-pass forward flowing serpentine flow cooling circuit located in the lower span section and having a second leg connected to the common cooling air supply channel and a third leg located along a leading edge of the airfoil;

a second three-pass forward flowing serpentine flow cooling circuit located in the upper span section and having a second leg connected to the common cooling air supply channel and a third leg located along a leading edge of the airfoil;

a first five-pass aft flowing serpentine flow cooling circuit located in the lower span section and having a second leg connected to the common cooling air supply channel and a fifth leg located adjacent to a trailing edge of the airfoil;

a second five-pass aft flowing serpentine flow cooling circuit located in the upper span section and having a second leg connected to the common cooling air supply channel and a fifth leg located adjacent to a trailing edge of the airfoil; and, the common cooling air supply channel forms the first leg for each of the serpentine flow cooling circuits.

2. The turbine rotor blade of claim 1, and further comprising:

a showerhead arrangement of film cooling holes connected to the third legs of the three-pass serpentine flow cooling circuits; and, a row of exit holes along the trailing edge connected to the fifth legs of the five-pass serpentine flow cooling circuits.

3. The turbine rotor blade of claim 1, and further comprising:

a plurality of tip cooling holes connected to the serpentine flow cooling circuits located in the upper span section.

4. The turbine rotor blade of claim 1, and further comprising:

a third three-pass forward flowing serpentine flow cooling circuit located in a middle span section and having a second leg connected to the common cooling air supply channel and a third leg located along a leading edge of the airfoil; and, a third five-pass aft flowing serpentine flow cooling circuit located in the middle span section and having a second leg connected to the common cooling air supply channel and a fifth leg located adjacent to a trailing edge of the airfoil.

5. The turbine rotor blade of claim 1, and further comprising:

each of the legs of the serpentine flow cooling circuits has side walls that extend from the pressure side to the suction side of the airfoil.

6. The turbine rotor blade of claim 1, and further comprising:

the serpentine flow cooling circuits extend from the platform section to the blade tip section of the airfoil.

* * * * *